United States Patent [19]

Rohrman

[11] Patent Number: 4,715,153

[45] Date of Patent: Dec. 29, 1987

[54] PANEL MOUNTING BUILDING WALL CONSTRUCTION

[75] Inventor: Henry Rohrman, Rochester, N.Y.

[73] Assignee: Schlegel Corporation, Rochester, N.Y.

[21] Appl. No.: 861,151

[22] Filed: May 8, 1986

[51] Int. Cl.[4] ..... E04B 2/88

[52] U.S. Cl. ..... 52/213; 52/235; 52/309.15; 52/397; 52/667; 52/781

[58] Field of Search ..... 52/397, 398, 235, 667, 52/495, 476, 781, 204, 213, 217, 206, 210

[56] References Cited

U.S. PATENT DOCUMENTS

| | | | |
|---|---|---|---|
| 1,717,740 | 6/1929 | Simon | 52/781 |
| 2,015,447 | 9/1935 | Esser | 52/213 |
| 2,197,761 | 4/1940 | Johanns | 52/204 |
| 2,475,885 | 7/1949 | Geyser | 52/476 |
| 2,607,453 | 8/1952 | Smith | 52/476 |
| 2,678,116 | 5/1954 | Gruber | 52/781 |
| 2,701,041 | 2/1955 | Toth | 52/398 |
| 2,993,242 | 7/1961 | Leisibach | 52/398 |
| 3,000,474 | 9/1961 | Friedman | 52/484 |
| 3,004,305 | 10/1961 | Goodemote | 52/397 |
| 3,176,806 | 4/1965 | Ferrell | 52/213 |
| 3,283,467 | 11/1966 | Znamirowski | 52/667 |
| 3,340,663 | 9/1967 | Collard | 52/204 |
| 3,357,145 | 12/1967 | Grossman | 52/397 |
| 3,736,717 | 6/1973 | Farley | 52/476 |
| 3,872,639 | 3/1975 | Crumbaugh | 52/781 |
| 3,940,899 | 3/1976 | Baliwski | 52/781 |
| 4,057,947 | 11/1977 | Kunimasa | 52/781 |
| 4,317,641 | 3/1982 | Sauer | 52/667 |
| 4,324,082 | 4/1982 | Rutkowski | 52/213 |
| 4,432,163 | 2/1984 | Cassiere | 52/213 |
| 4,542,615 | 9/1985 | McCall | 52/484 |
| 4,548,013 | 10/1985 | Briceno | 52/484 |
| 4,608,793 | 9/1986 | Yost | 52/475 |

FOREIGN PATENT DOCUMENTS

| | | | |
|---|---|---|---|
| 424750 | 2/1935 | United Kingdom | 52/213 |
| 1222145 | 2/1971 | United Kingdom | 52/397 |

*Primary Examiner*—John E. Murtagh

*Attorney, Agent, or Firm*—Cumpston & Shaw

[57] ABSTRACT

An improved panel mounting building wall construction is disclosed for use in curtain walls, store fronts and the like. The heart of the building wall construction comprises a J-shaped structural frame member adapted for universal use as a head member, side jamb member, a sill member, vertical mullion and horizontal transom member. The J-shaped frame member comprises a flat intermediate plate member, a head on one side of the plate members having portions thereof laterally extending outwardly in opposite directions from the plate member, and a foot member on the opposite side of the plate member laterally extending therefrom. The frame member further has a pair of opposed elongate lips on the plate member, one of the lips laterally extending from one side of the plate member and the other of the lips laterally extending from the opposite side of the plate member.

18 Claims, 8 Drawing Figures

PANEL MOUNTING BUILDING WALL CONSTRUCTION

FIELD OF THE INVENTION

This invention relates generally to building wall constructions, and more specifically to a panel mounting building wall construction for use in curtain walls, store fronts, window walls, vertical and horizontal strip walls, fixed and ventilated sashes and the like.

DESCRIPTION OF THE PRIOR ART

Fairly recent developments in materials and designs for the building construction industry have substantially revolutionized building construction. That is, with particular reference to multi-story commercial buildings, the focus has been to simplify and beautify the building by using wall panels of glass and/or other sheet material affixed by building wall construction to the structural skeleton of the building. In certain building designs, the window or glass areas span substantially all of the outer wall area. This is achieved by employing extremely large windows panels disposed in adjacent coplanar relationship relative to each other. Often times, these panels are of a height sufficient to extend vertically between one or more stories of the building and are many feet in width. In this type of desired building wall construction, rigid structual frame members, normally of a narrow width, are employed to join and support the adjacent panel edges.

The prior art is replete with patents disclosing structural frame members for supporting window panels or the like. Exemplary patents are U.S. Pat. No. 3,527,010 granted to Brzezinski et al., U.S. Pat. No. 3,866,374 granted to Dallen, U.S. Pat. No. 3,722,161 granted to Brown, and U.S. Pat. No. 3,798,862 granted to Stoakes.

One difficulty with previous structural frame members for panel mounting wall construction has been the lack of a universal or standard design frame element that can be used for the many different individual frame members such as vertical mullions, horizontal transom members, head members, side jamb members and sills. This has necessitated joining the frame members of different design together at corners and other junction points by, for example, specially designed brackets and plates, including screws and bolts. Since so many frame members of different design are needed for a panel mounting building wall construction, the labor costs in constructing such a building are enormous. This difficulty has been overcome by this invention in which the structural frame members for the walls all have the same basic design, merely requiring some additional finishing work on the member depending upon what function it is to serve, that is, as a vertical mullion, a horizontal transom member, a head member, side jamb member, or sill. Such work may involve, for example, cutting the frame members to the desired length, cutting off some of the frame members to a desired length with spaced projections and notches at the ends thereof, and cutting spaced notches in other frame members.

SUMMARY OF THE INVENTION

In accordance with a preferred embodiment of the invention, a panel mounting building wall construction is disclosed for supporting wall panels such as glass windows, metal panels or the like. The building wall construction comprises a unitary elongate structural frame member of substantially J-shaped cross-section for universal use as a head member, a side jamb member, a sill member, a vertical mullion, and a horizontal transom member. The frame member comprises an elongate flat intermediate plate member, a head on one side of the plate member at right angles thereto having portions of said head extending outwardly from each side of the plate member, and a laterally extending foot on the opposite side of the plate member parallel to one of the head portions. A pair of elongated lips are provided on the plate member with one of the lips laterally extending from one side of the plate member and the other of the lips laterally extending from the opposite side of the plate member. Preferably, the building wall construction further comprises a pair of elongated sealing assemblies, one of which is interposed between one of the lips and the head for releasably holding and sealing an edge of a wall panel therebetween, and the other of which is interposed between the other lip and the head for releasably holding and sealing an edge of another wall panel therebetween. In accordance with one aspect of the invention, a thermally insulating coating is applied to at least the portion of the J-shaped member that will be exposed to weather.

While the invention is described in connection with a presently preferred embodiment having generally rectangular or square plate members, other arrangements may be constructed. Among these are curved plates, triangular or other plane geometric shaped plates and combinations of these. Such arrangements are useful in curved and taper top building constructions and constuctions using sloped glazing.

In a more specific aspect of the invention, a panel mounting building wall construction is disclosed comprising at least a pair of parallel, spaced apart elongate vertical mullions and a pair of parallel, spaced apart horizontal transom members. The mullions and transom members each have identical J-shaped cross-sections, and are usually oriented at right angles to each other. One pair of the mullions or transom members have spaced apart transverse slots, and the other pair of mullions or transom members have projections and notches at opposite ends thereof insertable through complementary slots in the one pair of mullions or transom members to form a frame for receiving a glass wall panel or the like.

A primary advantage of this invention is to provide an improved panel mounting building wall construction that is of simple design and construction in which only a single, universal part is involved which does not have to be held to close tolerances. The universal part, which is the heart of the building wall construction, is a J-shaped structural frame member that, with slight alteration in the factory or at the building site, can function as a head member, a side jamb member, a sill member, a horizontal transom member, or a vertical mullion. The transom members and mullions are secured together at the junctions thereof by a simple projection and notch connection in mating ends of a pair of one of the transom members and mullions insertable through a slot in the other of the transom member and mullion thereby obviating the need for any drilled openings, nuts and bolts, specialized brackets and other parts of different sizes. The improved building wall construction is material and labor cost effective.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
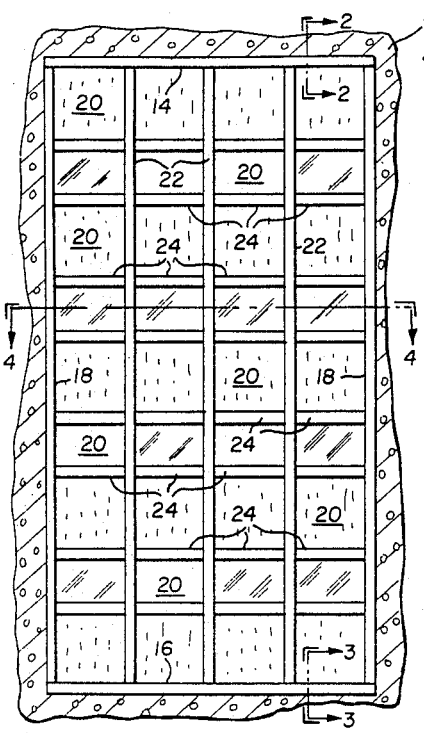
FIG. 1 is a segmental front elevational view of a vertical curtainwall in which a preferred embodiment of a panel mounting building wall construction of this invention is incorporated.

Referring now to FIG. 1 of the drawings, a preferred embodiment of a panel mounting building wall construction of this invention is shown incorporated in a vertical curtain wall 10. It should be understood that the panel mounting building wall construction is also usable in other applications, such as store fronts or the like.

The curtain wall 10 of FIG. 1 is mounted within an opening defined by a portion of the structural skeleton 12 of a building, not shown, formed from reinforced concrete, structural steel or the like. The curtain wall is secured to building skeleton 12 by a head member 14, sill member 16, and side jamb members 18. Panels 20 of different size formed from any suitable transparent or nontransparent material, such as glass, metal or the like, or composite panels such as prefabricated insulated panels faced with stone, metal, ceramic, epoxy or similar materials are supported within the head member, sill member and side jamb members by vertical mullions 22 and intersecting horizontal transom members 24.

Figure 7:
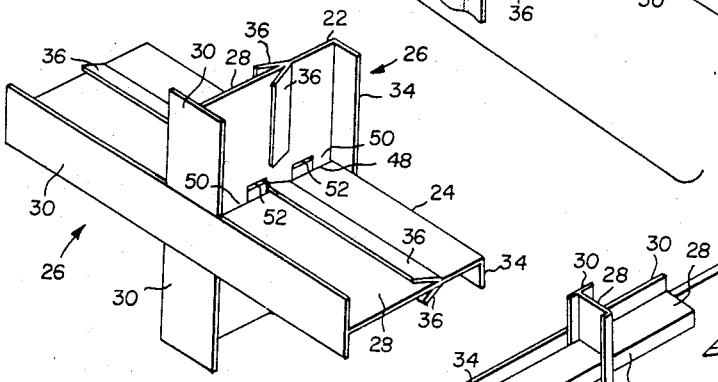
FIG. 7 is an enlarged perspective view of a junction in which the slot is located in the horizontal transom member and the mating projections and notches are on the vertical mullion.

The heart of the panel mounting building wall construction of this invention is a universal structural frame member 26 for forming the head member 14, sill member 16, side jamb members 18, elongated mullions 22 extending substantially the entire length of the frame transom members 24 separated by, and perpendicular to, the mullions as shown in FIG. 1. As used herein, unless otherwise specifically set forth, mullions refers to the elongated continuous members and transoms refers to the intermediate members disposed between adjacent mullions. While mullions may be disposed horizontally as shown in FIG. 7, or vertically, it is preferred that when they are load-bearing, they be vertical. The frame member 26 is of a substantially J-shaped cross-section shown diagrammatically in FIGS. 2–4, and in an actual preferred form in FIG. 5. The J-shaped frame member 26 is preferably manufactured by a roll-forming process in which a flat steel sheet is rolled by suitable roll-forming apparatus to form the J-shaped frame member. Cutting means, not shown, are provided in the factory or at the job site to cut the J-shaped frame member 26 into the desired lengths for use in building wall construction. Although J-shaped frame members formed by roll-forming is preferable, the frame member can also be formed by an extrusion process, for example.

Figure 5:
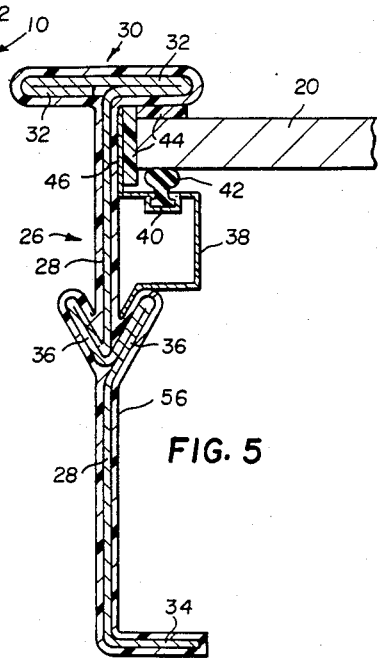
FIG. 5 is an enlarged section view of the actual J-shaped frame member employed in the building wall construction of FIGS. 1–4.
Figure 2:
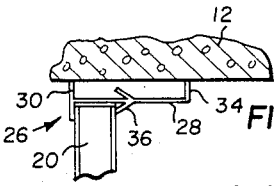
FIG. 2 is a simplified section view taken substantially along line 2—2 of FIG. 1 in which the J-shaped frame member is shown in diagrammatic form.
Figure 4:
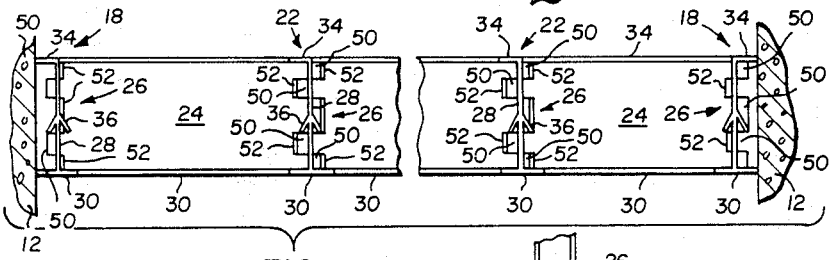
FIG. 4 is an enlarged section view taken substantially along line 4—4 of FIG. 1 with the panels omitted for purpose of clarity, and the J-shaped frame members shown diagrammatically.
Figure 3:
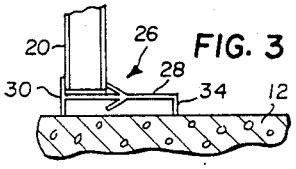
FIG. 3 is a simplified section view taken substantially along line 3—3 of FIG. 1 in which the J-shaped frame member is shown in diagrammatic form.

The unitary J-shaped frame member 26, as seen in FIG. 5, comprises a flat intermediate plate member 28 having a flat decorative head 30 on one side thereof facing the exterior of the building (see FIGS. 1 and 4). The head is at right angles to the plate member and has lateral portions 32 thereof extending outwardly from opposite sides of plate member 28. The frame member 26 further has a laterally extending foot 34 on the opposite side of plate member 28 forming an interior wall surface. The foot 34 and a lateral head portion 32 are preferably of equal width to properly position and stabilize the frame member when it is secured by any suitable means, not shown, to the concrete building skeleton 12, as best seen in FIGS. 2–4. While the width of the head and foot portions may be varied according to the appearance and strength desired, the foot should be sufficiently narrow to allow a panel to be inserted into the space between adjacent mullions and transom members after the frame has been erected.

Again, with reference to FIG. 5, plate member 28 of J-shaped member 26 is provided with a pair of directly opposed flanges or lips 36, one extending laterally outwardly from one side of plate member 28 and the other extending from the opposite side of the plate member. The lips 36 provide a stop for one end of a resilient sealing assembly or clip 38. The clip has a T-shaped slot 40 for receiving a complementary T-shaped end of a weatherseal 42 mounted therein to complete a sealing assembly. The weatherseal bears against one side of a panel 20 for releasably holding an edge of the panel against a lateral head portion 32. The particular weathersealing clip 38 is intended to be exemplary and not limiting. A variety of spacing, sealing and mounting assemblies may be employed. For example, a seal similar to a conventional flange mounted bulb type automobile door seal as shown in U.S. Pat. No. 4,343,845 may be installed on a flange arranged perpendicular to plate member 28. Alternatively, a flange mounted glazing strip such as the one shown and described in British Pat. No. 1,522,634 may be employed. Glazing strips 44 of any suitable material are interposed between an edge of panel 20 and plate member 28, and a side of the panel and head portion 32 to take up any slack that may develop when panel 20 is subjected to wind forces and expansion and contraction of the panels, or the like. The opposite end 46 of clip 38 is interposed between a glazing strip 44 and plate member 28. A shorter similar clip, not shown, may be used to accommodate and releasably hold a panel 20 of wider width, such as a double glazed window, or the like. The lips 36 extend along the full length of plate member 28, and the clips 38 preferably extend along the full length and width of a panel 20.

Figure 6:
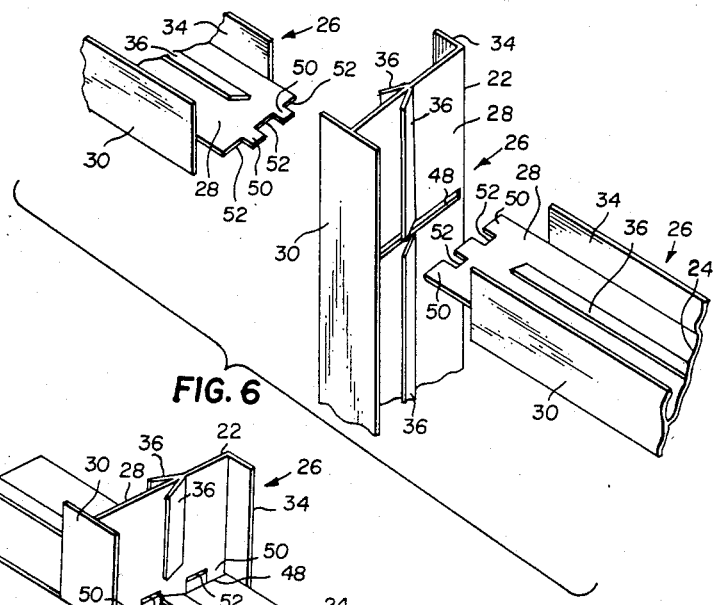
FIG. 6 is an enlarged exploded view in perspective of one of the junctions shown in FIG. 4 in which the slot is located in the vertical mullion and the mating projections and notches are on the horizontal transom members.

With reference to FIGS. 4 and 6, the modifications to J-shaped frame member 26 required to join them together to form vertical mullions 22 and horizontal transom members 24 will now be described. For the vertical curtain wall construction of FIG. 1, J-shaped frame members 26 are cut to the desired length and provided with spaced apart elongated slots 48 extending through lips 36 and plate member 28 to form the vertical mullions. Portions of other J-shaped frame members 26 are cut off at the desired length with flat extending projections 50 and notches 52 at each end thereto to form the horizontal transom members. The mullions 22 and transom members 24 are joined together, as best seen in FIG. 4, by extending complementary ends of adjacent transom members into slots 48 in the mullions 22 with complementary projections 50 and notches 52 thereof in mating engagement. In this position, the projections 50 of the mating ends of the transom members bear against the mullion plate member 28 to support any load on the transom members 24. Sufficient clearance is provided between the mating projections 50 and notches 52 to compensate for any expansion or contraction of the transom members 24 due to heat or cold. Additionally, projections 50 and notches 52 are sufficiently long so that even when transoms 24 contract due to cold, the projections do not completely withdraw from slots 48 and allow the transoms to become dislodged. Accordingly, with this simple projection 50, notch 52 and slot 48 arrangement, it is possible to join vertical mullions 22 and horizontal transom members 24 without the necessity of special brackets, special parts, plates, nuts or bolts. To form a horizontal curtain wall, as best seen in FIG. 7, the horizontal transom member 24 is provided with slots 48, and the vertical mullions 22 are provided with complementary mating projections 50 and notches 52 thereon.

Figure 8:
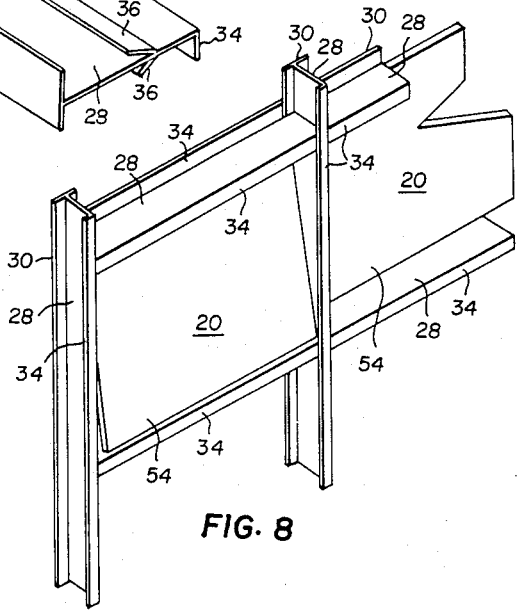
FIG. 8 is a simplified rear elevational view of a portion of the curtain wall of FIG. 1 showing one panel installed and another panel in the process of being installed.

With reference to FIG. 8, it can be seen that the J-shaped mullions 22 and transom members 24 are oriented so that for each frame opening 54, two adjacent feet 34 extend laterally toward the opening and the other two feet extend laterally away from the opening. This allows sufficient space for a panel 20 to be installed into frame opening 54 formed by the mullions 22 and transom members 24. After panel 20 is moved into position as seen on the right, the aforementioned clips 38 are installed for releasably securing the panel within the frame opening.

Although the J-shaped frame member may be formed of any suitable material, a preferred embodiment comprises a steel J-shaped frame member coated with an elastomeric or other thermally insulating coating 56, as best seen in FIG. 5. The steel adds structural strength without adding bulk and does not expand and contract as much as other metals such as aluminum. A suitable elastomeric coating 56 for the frame member 26 is SANTOPRENE, registered trademark of Monsanto. The elastomeric coating 56 serves a number of functions such as protecting the steel from corrosion and reducing the building noise that is generated when the building wall construction expands and contracts due to changing temperatures. The coating also provides thermal insulation without reducing the structural strength of the curtain wall members which occurs in conventional thermal break systems.

The invention has been described in detail with particular reference to preferred embodiments thereof, but it will be understood that variations and modifications can be effected within the spirit and scope of the invention, for example, the coating may encapsulate the entire J-shaped frame member or may be limited to only a portion of the member covering the portion from the lips around the head.

What is claimed is:

1. A panel mounting building wall construction comprising:

a unitary elongate roll formed structural frame member of substantially J-shaped cross-section having a flat elongate intermediate plate member characterized by a first thickness, an elongate head, characterized by a first width, on one edge of said plate member transverse thereto and having lateral portions of said head extending outwardly in each direction away from said plate member, and an elongate laterally extending foot on the opposite edge of said plate member extending outwardly away from said plate, said foot having a width substantially equal to one half of said first width;

a pair of elongate lips on said plate member, one of said lips laterally extending from one side of said plate member and the other of said lips laterally extending from the opposite side of said plate member;

a seal assembly interposed between at least one of said lips and said head for releasably holding an edge of a wall panel therebetween; and at least one transverse slot extending through the plate member and at least one flat end portion, insertable through said slot extending outwardly from said member a distance at least equal to the thickness of said member.

2. A building curtain wall construction according to claim 1 wherein said structural frame member is roll-formed from a flat metal sheet.

3. A building curtain wall construction according to claim 1 wherein said lips are substantially symmetrical.

4. A building curtain wall construction according to claim 1 wherein said lips extend from said plate member towards said head and form an acute angle with said plate member.

5. A building curtain wall construction according to claim 1 wherein glazing material is mounted on an inner surface of one of said lateral head portions and on an outer surface of said plate member adjacent said one head portion for engagement by the edge of the wall panel.

6. A building curtain wall construction according to claim 1 wherein at least a portion of said head is coated with an elastomeric material.

7. A building curtain wall construction according to claim 1 wherein at least said head and a part of said plate member adjacent thereto are coated with an elastomeric material.

8. A building curtain wall assembly according to claim 1 wherein said seal assembly comprises an elongate resilient clip.

9. A J-shaped roll formed structural frame member for universal use as a head member, a side jamb member, a sill member, an elongate mullion and a transom member in a building wall construction comprising;

an elongate flat intermediate plate member characterized by a first thickness;

an elongate head on one edge of said plate member transverse thereto characterized by a first width and having portions of said head laterally extending outwardly in opposite directions away from said plate member;

an elongate foot on the opposite side of said plate member characterized by a width substantially equal to one half said first width laterally extending outwardly transverse to said plate member;

a pair of elongate lips on said plate member, one of said lips laterally extending from one side of said plate member and the other of said lips laterally extending from the opposite side of said plate member; at least one transverse slot extending through the plate member; and at least one flat end portion, insertable through said slot extending outwardly from said member a distance at least equal to the thickness of said member.

10. A J-shaped structural frame member according to claim 9 wherein said structural frame member is roll-formed from a flat metal sheet.

11. A J-shaped structural frame member according to claim 9 wherein said lips extend from said plate member towards said head and form an acute angle with said plate member.

12. A J-shaped structural frame member according to claim 9 wherein said lips are substantially symmetrical.

13. A J-shaped structural frame member according to claim 9 wherein at least said head and a part of said plate member adjacent thereto are coated with an elastomeric material.

14. A frame construction for supporting wall panels in curtain walls or the like comprising:

at least a pair of parallel, spaced-apart roll formed, elongate mullion members, each of substantially J-shaped cross-section having an elongate flat intermediate mullion plate characterized by a first thickness and having an elongate flat mullion head member on one edge thereof having head portions characterized by a first width laterally extending outwardly in each direction away from said mullion flat plate, and an elongate mullion foot member on the opposite edge thereof characterized by a width substantially equal to said first width laterally extending outwardly away from said mullion flat plate, and an elongate laterally extending lip intermediate said head and foot members;

at least a pair of parallel, spaced-apart roll formed transom members, each of substantially J-shaped cross-section identical to said J-shaped cross-section of said mullion members and oriented transverse to said mullion members; and one of said pairs of said mullion and transom members having spaced apart transverse slots, extending through the member, and the other of said pair of said mullions and transom members having opposite flat end portions extending outwardly from the ends of said member a distance at least substantially equal to the thickness of the intermediate plate of the other of said members insertable through complementary ones of said slots in said one of said pairs of said mullion and transom members to form a frame for receiving a wall panel.

15. A frame construction according to claim 14 wherein one of said flat end portions has a notch of a depth at least equal to the thickness of one of said mullion and transom plates and of a predetermined width, and said opposite flat end portion has a projection of a length substantially equal to the depth of said notch and a width slightly less than said predetermined width.

16. A frame construction according to claim 14 wherein said mullion and transom members are at least partially coated with an elastomeric material.

17. A frame construction for supporting wall panels in curtain walls or the like comprising:

at least a pair of parallel, spaced-apart elongate roll formed mullion members, each of substantially J-shaped cross-section having an elongate flat intermediate plate member, an elongate flat head member having a first width on one edge of said intermediate plate member, and an elongate foot member on the opposite edge of said intermediate plate said foot member having a width substantially equal to one half the width of said flat head member and an elongate laterally extending lip intermediate said head and foot members;

at least a pair of parallel, spaced-apart roll formed transom members, each of substantially J-shaped cross-sections being identical to said J-shaped cross-section of said mullion members and oriented transverse to and between said mullion members; and spaced apart transverse slots extending through said mullion members, and opposite flat end portions in said transom members insertable through complementary ones of said slots in said mullion members to form a frame for receiving a wall panel.

18. A frame construction for supporting wall panels in curtain walls or the like comprising:

at least a pair of parallel, spaced-apart elongate roll formed mullion members, each of substantially J-shaped cross-section having an elongate flat intermediate plate member, an elongate flat head member on one edge of said intermediate plate member, characterized by a first width, and an elongate foot member on the opposite edge of said intermediate plate member characterized by a width substantially equal to one half said first width, and an elongate laterally extending lip intermediate said head and foot members;

at least a pair of parallel, spaced-apart roll formed transom members, each of substantially J-shaped cross-section having an elongate flat intermediate plate member, an elongate flat head member on one edge of said intermediate plate member characterized by a first width and an elongate foot member on the opposite edge of said intermediate plate member characterized by a width substantially equal to one half said first width, and an elongate laterally extending lip intermediate said head and foot members; oriented transverse to said mullion members; and one of said pairs of said mullion and transom members having spaced-apart transverse slots, and the other of said pairs of said mullion and transom members having opposite flat end portions insertable through complementary ones of said slots in said one of said pairs of said mullion and transom members to form a frame for receiving a wall panel.

* * * * *